US007179114B1

(12) United States Patent
Kuzan et al.

(10) Patent No.: US 7,179,114 B1
(45) Date of Patent: Feb. 20, 2007

(54) DIRECT BURY TRACER WIRE CONNECTOR

(75) Inventors: Pawel Kuzan, Oakville (CA); Dennis R. Jarnecke, River Forest, IL (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 11/351,413

(22) Filed: Feb. 10, 2006

(51) Int. Cl.
*H01R 4/26* (2006.01)

(52) U.S. Cl. ..... 439/402; 439/404

(58) Field of Classification Search ..... 439/395, 439/402, 404, 405, 417
See application file for complete search history.

(56) References Cited

U.S. PATENT DOCUMENTS 6,368,142 B2 * 4/2002 Katoh et al. ..... 439/402
6,457,898 B1 * 10/2002 Donovan et al. ..... 403/165
6,685,497 B1 * 2/2004 Urban et al. ..... 439/417
6,755,678 B2 * 6/2004 Ward et al. ..... 439/402
6,769,931 B2 * 8/2004 Negishi et al. ..... 439/404
6,837,737 B2 * 1/2005 Baier et al. ..... 439/402

* cited by examiner

*Primary Examiner*—Khiem Nguyen
(74) *Attorney, Agent, or Firm*—Mark E. Fejer

(57) ABSTRACT

A tracer wire connector (10) having two parts, a main body (11) and a cover (12). The main body includes a base (16) and a raised portion (24) connected with the base, the raised portion forming a first groove (13) extending from one side of the base to an opposite side of the base, the raised portion forming an at least partially closed bore (14) having a closed off end (17) extending parallel to the first groove, and the raised portion forming a second groove (15) traversing the first groove and the bore. The cover forms a cavity (23) adapted to receive the main body and includes at least one cutting element (22) disposed within the cavity aligned to fit into the second groove upon insertion of the main body into the cover. Disposed within the cover is a displaceable insulating material which is displaced to fill empty space within the connector upon insertion of the main body into the cover.

25 Claims, 4 Drawing Sheets

DIRECT BURY TRACER WIRE CONNECTOR

BACKGROUND OF THE INVENTION

1. Field of the Invention

This invention relates to a device for connecting wires. More particularly, this invention relates to a device for connecting wires, known as tracer wires, placed near buried utilities, such as plastic natural gas pipes, for the purpose of locating these utilities.

2. Description of Related Art

Pipes buried below the surface of the earth require periodic service and/or repair. Damaged pipes must be located and excavated in order to receive such service. Location of underground pipes is a traditionally difficult task, especially in areas containing large networks of underground pipes, wires and other buried objects. In addition, it is preferred that methods employed in locating buried utilities operate from above ground and that they not require prior knowledge of the location of, or access to, the utility to introduce special signals for detection.

Underground pipelines are generally constructed of either metal or, commonly, plastic such as polyethylene and polyvinyl chloride. Plastic is a preferred pipe material because it is durable, inexpensive, lightweight, inert, easy to manufacture and easy to install. However, in the absence of some detection means associated therewith, plastic pipe is virtually undetectable with traditional underground pipeline location methods.

One means for addressing the problem of locating non-electrically conductive, non-magnetic buried utilities is the use of tracer wires which run along the buried utility and are installed when the utility distribution network is being constructed or when a new service connection is being added to an existing network. When a new service is added to an existing network, the tracer wire associated with the new service, referred to herein as a branch wire, must be connected to the tracer wire, i.e. primary tracer wire, running along the main buried utility. Such tracer wire connections are currently made either by using a standard insulation-displacement connector and then applying environmental insulation to the assembled connector and wires, or by using direct burial connectors that are designed, in general, for other applications. All currently used connectors are applied manually and the connection cannot be made remotely, such as in a keyhole.

To be suitable for use with underground utilities, direct bury tracer wire connectors must be able to provide a reliable electrical connection between the main tracer wire and the branch wire, must have adequate mechanical strength, must be environmentally sealed, must be economical to manufacture, and must be easy to apply. In addition, because new service connections are sometimes made using small size excavations, i.e. keyholes, it should be possible to apply the connector using a simple, remotely operated tool.

There exist at the present time numerous tap connectors on the market that allow for the connection of a branch wire to a running trace wire without cutting the running wire or stripping the insulation from the wire. Examples of such products include SCOTCHLOK® tap connectors from 3M Corporation and ELECTRO-TAP® connectors from AMP/TYCO. However, these connectors are generally not environmentally protected. Selected models are available prefilled with silicone grease, but the design of the connectors does not assure reliable protection against environmental factors. In addition, the connector application is performed in several steps that require multiple tools and considerable manual dexterity of the person using the connector.

Insulation piercing connectors, such as the KZ-series from TYCO Electronics, are also known. Although intended for direct burial, these connectors are designed for high voltage and high current carrying capacity and their wire gage ranges are not suitable for use as tracer wires. Because the connectors require hand tools and proper alignment of the connectors and the tracer wires during installation, remote installation would be difficult, if not impossible. In addition, insulation piercing connectors are relatively expensive.

Yet another type of known connector is the DRYCONN® direct bury lug from King Innovations, St. Charles, Mo. This is the only commercial connector known to us that is suitable for use with tracer wires. It is environmentally sealed and relatively inexpensive. However, both the branch wire and the main tracer wire need to be stripped prior to installation. In addition, the wires are secured in the connector block by tightening two small screws. Thus, the connector can only be applied manually, i.e. it is not suitable for remote applications.

SUMMARY OF THE INVENTION

It is one object of this invention to provide a tracer wire connector that can be remotely installed.

It is one object of this invention to provide a tracer wire connector that can be installed in a single step.

It is one object of this invention to provide a tracer wire connector that can be installed without stripping of the tracer wire.

It is another object of this invention to provide a tracer wire connector that is environmentally protected.

It is another object of this invention to provide a tracer wire connector that provides a reliable electrical connection between the connected tracer wires.

These and other objects of this invention are addressed by a tracer wire connector comprising a main body and a cover. The main body comprises a base and forms a first groove extending across the base; the main body forms retaining means for retaining a tracer wire within the connector substantially parallel to the first groove; and the main body forms a transverse groove traversing the first groove and the retaining means. The cover forms a cavity adapted to receive the main body and is provided with at least one cutting element disposed within the cavity aligned to fit into the transverse grove upon covering of the main body with the cover. To prevent the main body and cover from separating after assembly, locking means are provided for locking the main body and the cover together.

BRIEF DESCRIPTION OF THE DRAWINGS

These and other objects and features of this invention will be better understood from the following detailed description taken in conjunction with the drawings, wherein.

DETAILED DESCRIPTION OF THE PRESENTLY PREFERRED EMBODIMENTS

Figure 1:
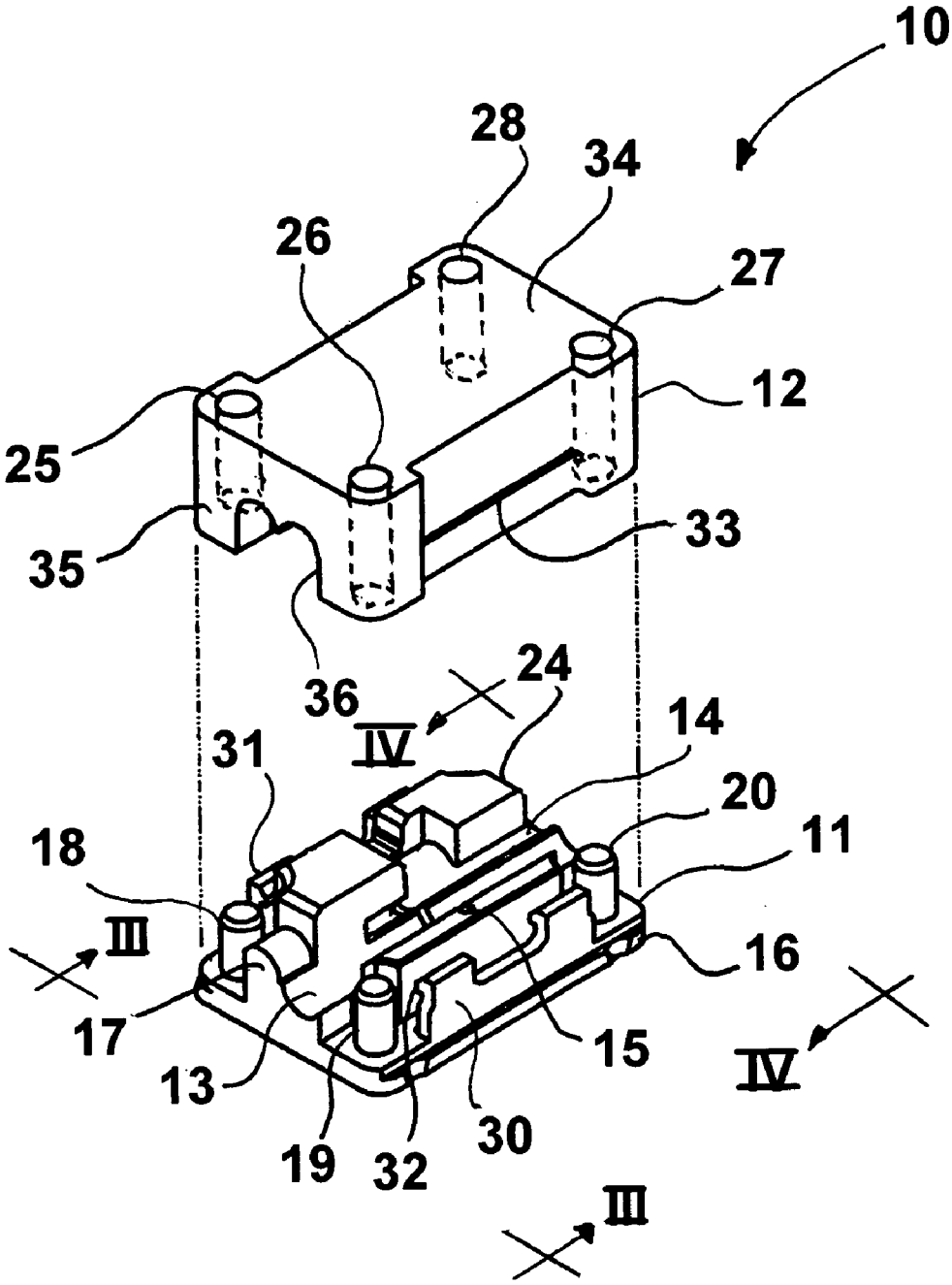
FIG. 1 is an exploded perspective view of the tracer wire connector in accordance with one embodiment of this invention.
Figure 2:
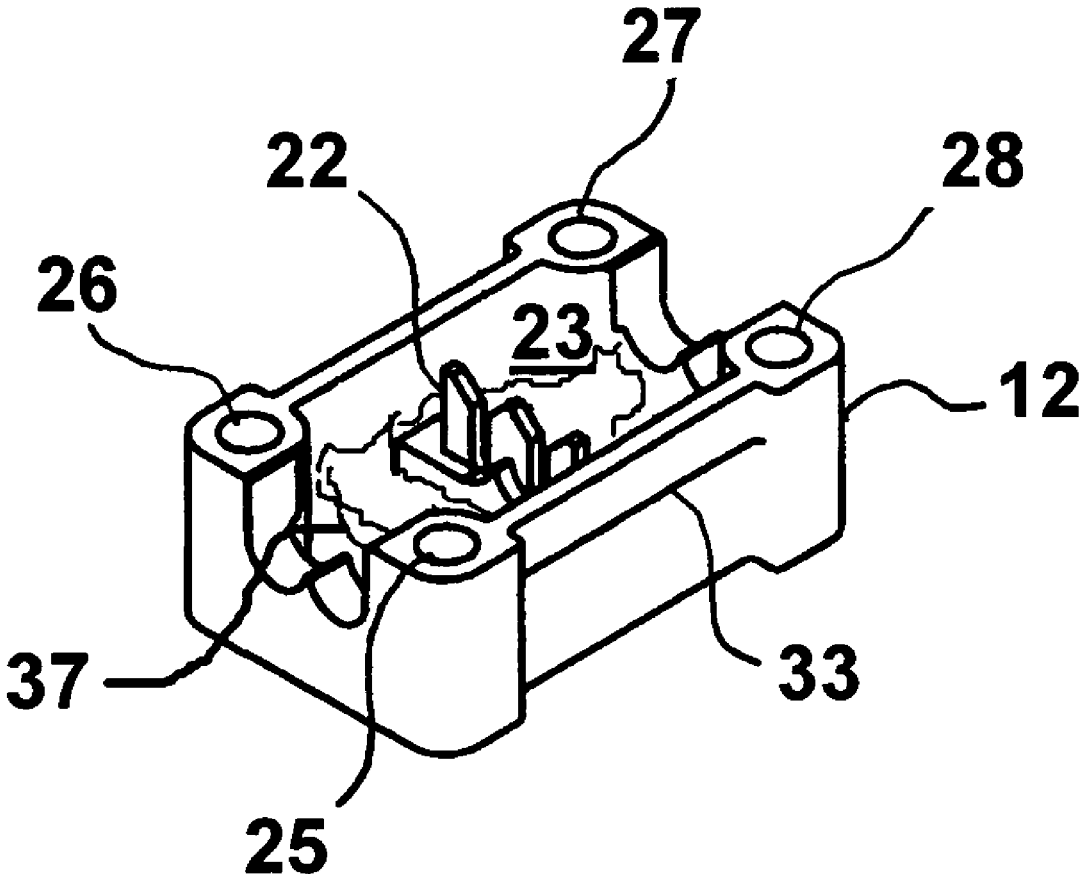
FIG. 2 is a perspective view of the inside of the cover of the tracer wire connector in accordance with one embodiment of this invention.

The tracer wire connector 10 in accordance with one embodiment of this invention as shown in FIG. 1 comprises two components made of plastic—main body 11 and cover 12—that are coupled together during the application of the connector to a primary tracer wire and a branch tracer wire. The main body comprises adapters that hold and stabilize the wires during the closing of the connector. More particularly, main body 11 comprises base 16 and raised portion 24, the latter of which forms a first groove 13 extending across the base. First groove 13 is used for placement and retention of the primary tracer wire within the connector. Main body 11 forms retaining means for retaining the branch tracer wire within the connector substantially parallel to first groove 13. In accordance with one embodiment of this invention, main body 11 forms an at least partially enclosed bore 14 substantially parallel to the first groove 13 having closed off end 17 into which the end of the branch tracer wire is inserted and retained. In accordance with one embodiment of this invention, bore 14 is tapered proximate closed off end 17 as shown in FIG. 5 to further promote retention of the branch tracer wire end within the bore.

Cover 12 of the tracer wire connector of this invention comprises a base wall 34 and at least one side wall 35 adjacent to the base wall, forming cavity 23, which is adapted to receive main body 11. Side wall 35 forms at least one cutout 36 on opposed sides of cover 12, one of the cutouts aligned with an end of first groove 13 and bore 14 and adapted in combination with main body 11 to fully enclose the primary tracer wire disposed in first groove 13 and the branch tracer wire disposed within bore 14, and the other of the cutouts aligned with the opposite end of first groove 13 and adapted in combination with main body 11 to fully enclose the primary tracer wire extending from the opposite end of first groove 13. Disposed within cavity 23 is at least one cutting element 22. Cutting element 22 is preferably in the form of a metal insulation-displacement contact blade which, upon assembly of the main body with the cover, penetrates through the insulation of the primary and branch tracer wires to provide an electrical connection therebetween.

Figure 5:
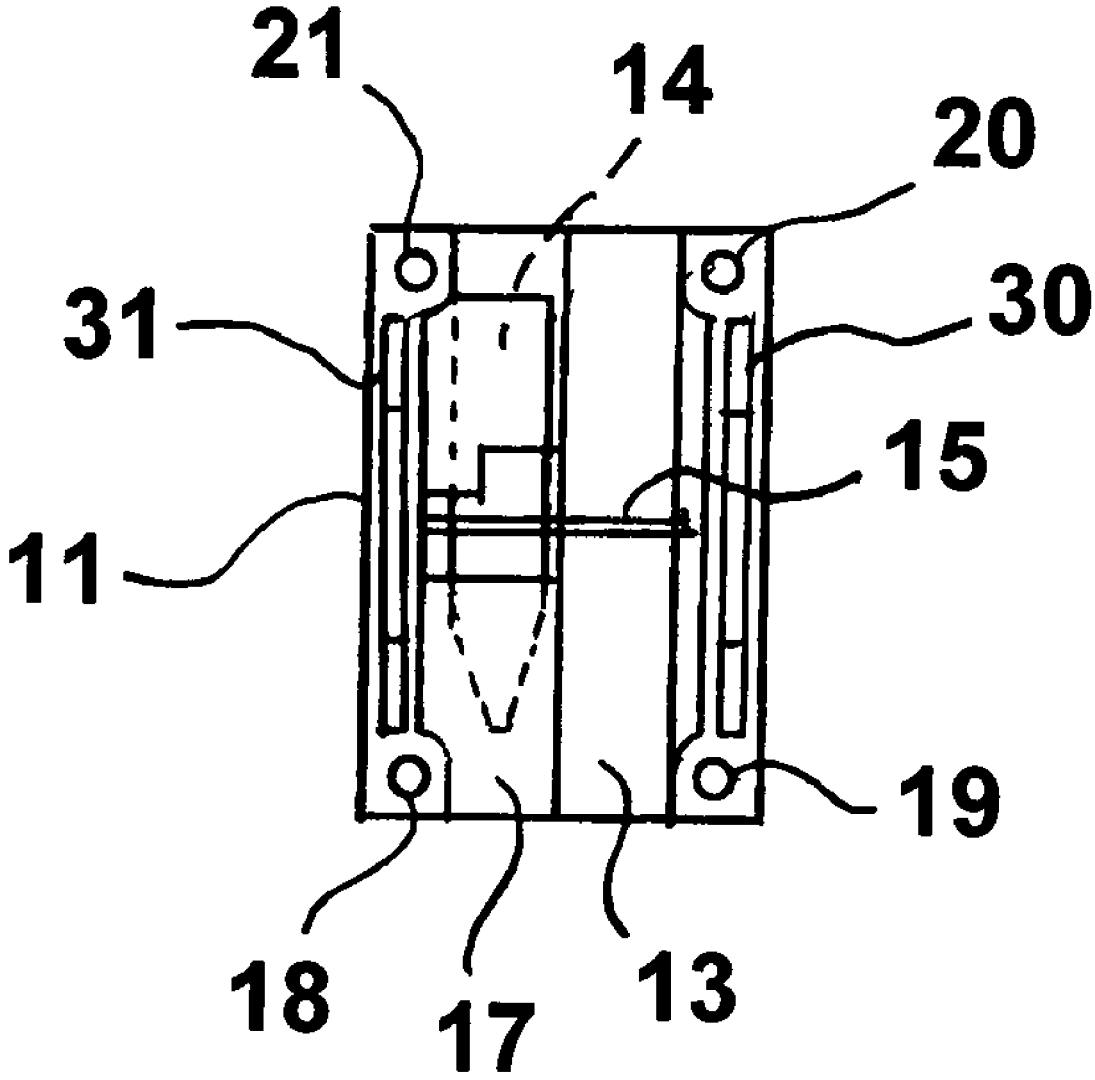
FIG. 5 is a top view of the main body of the tracer wire connector in accordance with one embodiment of this invention.

As shown in FIGS. 1 and 5, main body 11 forms second groove 15, a groove which is transverse to first groove 13 and bore 14 and which extends below both first groove 13 and bore 14. Second groove 15 is aligned within main body 11 to receive cutting element 22 upon assembly of the main body with the cover.

To ensure proper alignment of the cover and the main body for assembly, the tracer wire connector of this invention comprises alignment means for aligning the main body and the cover for assembly of the connector. In accordance with one embodiment of this invention, the alignment means comprises a plurality of alignment posts 18, 19, 20, 21 extending upward from, and disposed proximate the periphery of, base 16 as shown in FIGS. 1 and 5. The alignment means further comprises a plurality of corresponding cover bores 25, 26, 27, 28 formed by cover 12 which are arranged to receive alignment posts 18, 19, 20, 21, respectively.

As previously indicated, cover 12 is adapted to receive main body 11 during assembly of the tracer wire connector. In accordance with one embodiment of this invention, an insulating material 37 is disposed within cavity 23 of cover 12. In accordance with one preferred embodiment, the insulating material is a displaceable material whereby, upon covering of the main body by the cover, portions of raised portion 24 displace part of the insulating material, thereby enabling the insulating material to fill the entire remaining space within the connector, insulating cutting element 22 and any exposed parts of the tracer wires. In accordance with one embodiment of this invention, the displaceable insulating material is a silicone grease. It will be apparent to those skilled in the art that there exist other displaceable insulating materials which are suitable for use in the tracer wire connector of this invention, and such insulating materials are deemed to be within the scope of this invention.

Figure 3:
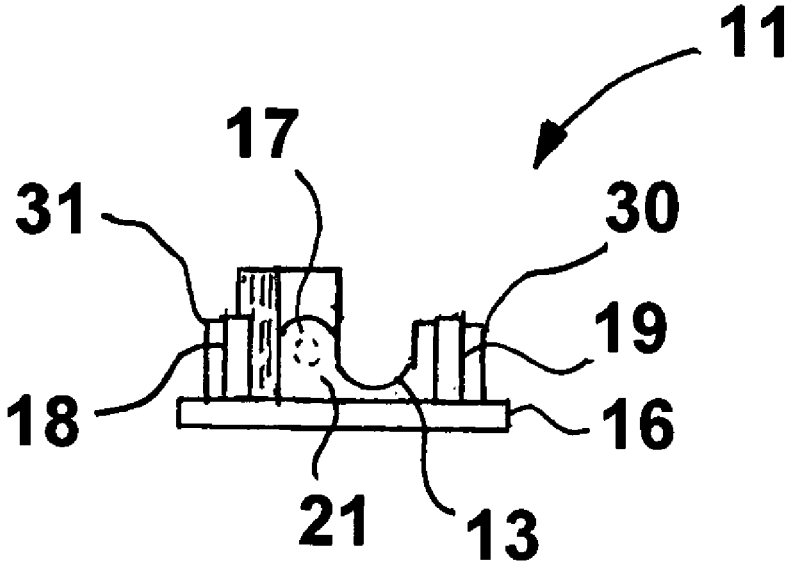
FIG. 3 is an end view of the main body of the tracer wire connector taken along the line III—III shown in FIG. 1 in accordance with one embodiment of this invention.
Figure 4:
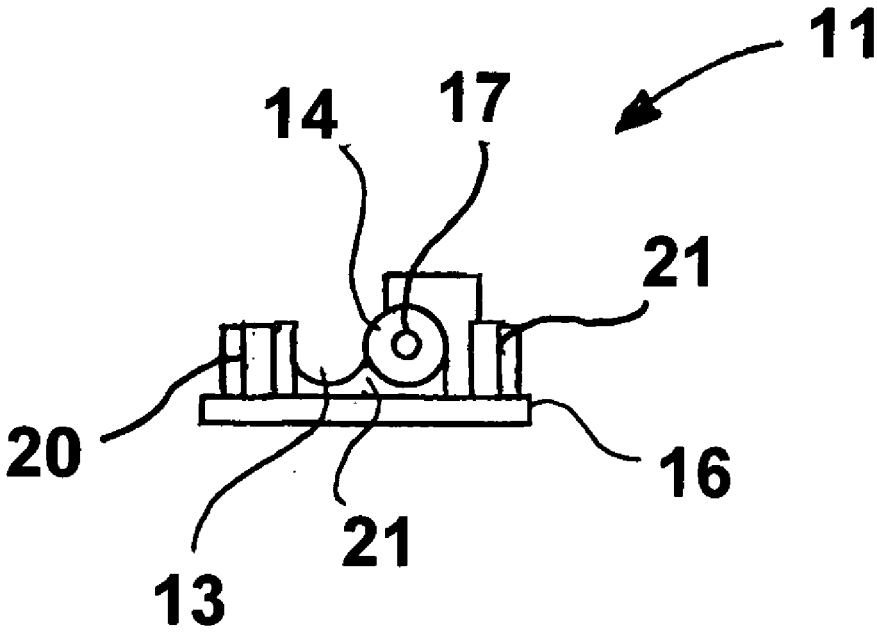
FIG. 4 is an end view of the main body of the tracer wire connector taken along line IV—IV shown in FIG. 1 in accordance with one embodiment of this invention.

Upon assembly of the tracer wire connector of this invention, locking means for locking main body 11 and cover 12 together are provided. In accordance with one embodiment of this invention, the locking means comprises two opposed walls 30, 31 as shown in FIG. 3, upwardly extending from, and disposed proximate the periphery of, base 16 of main body 11. Each opposed wall 30, 31 is provided with an inwardly extending profile 32. The locking means further comprises an outwardly extending ridge or ledge 33 disposed on the outer surface of the side walls of cover 12 and running substantially parallel to the inwardly extending profiles of opposed walls 30, 31. Upon insertion of main body 11 into cover 12, profiles 30, 31 engage ridge 32, thereby locking the main body within the cover.

In operation, the tracer wires are first inserted into the main body; the end of the branch wire is inserted into bore 14 and the primary tracer wire is inserted into first groove 13, extending across base 16. Depending upon whether or not bore 14 has a closed off end, the end of the branch wire may extend beyond the end of bore 14. Main body 11 and cover 12 are then brought together and pressed against each other. Alignment posts 18, 19, 20, 21 slide into cover bores 25, 26, 27, 28, respectively, thus guiding the main body and cover. As the main body and cover come together, cutting element 22 contacts the branch tracer wire and the primary tracer wire, cutting through the insulating jackets of both wires and providing an electrical connection between the tracer wires. At the same time, raised portion 24 of main body 11 is pushed into the insulating material disposed in cavity 23 of cover 12, gradually displacing the insulating material to fill the spaces within the interior of the assembled connector. In the last stage of connector closing, profiles 32 and ridges 33 engage, locking the main body and the cover together.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. A tracer wire connector comprising:

a main body having a base, said main body forming a first groove extending across said base, said main body forming retaining means for retaining a portion of a wire within said connector substantially parallel to said first groove, and said main body forming a transverse groove traversing said first groove and said retaining means;

a cover forming a cavity adapted to receive said main body, said cover having at least one cutting element disposed within said cavity aligned to fit into said transverse groove upon covering of said main body with said cover; and locking means for locking said main body and said cover together.

2. A tracer wire connector in accordance with claim 1, wherein said retaining means comprises an at least partially closed bore formed by said main body, said bore having a closed off end.

3. A tracer wire connector in accordance with claim 2, wherein said bore is tapered in a direction of said closed off end.

4. A tracer wire connector in accordance with claim 1, wherein a displaceable insulating material is disposed within said cavity.

5. A tracer wire connector in accordance with claim 4, wherein said displaceable insulating material is a silicone grease.

6. A tracer wire connector in accordance with claim 1 further comprising alignment means for aligning said main body and said cover for assembly of said connector.

7. A tracer wire connector in accordance with claim 6, wherein said alignment means comprises a plurality of posts extending upward from said base and connected with said base along a periphery of said base.

8. A tracer wire connector in accordance with claim 7, wherein said cover forms a plurality of cover bores, each of said cover bores arranged to receive one of said plurality of posts.

9. A tracer wire connector in accordance with claim 4, wherein said main body comprises displacement means for displacing said displaceable insulating material upon assembly of said main body with said cover.

10. A tracer wire connector comprising:

a main body having a wire entry edge and a wire exit edge and forming a first groove from said wire entry edge to said wire exit edge;

said main body having a raised portion extending parallel to said first groove and forming an at least partially enclosed bore parallel to said first groove, said bore having a first open end proximate said wire entry edge and one of a second open end and a closed off end proximate said wire exit edge;

said main body forming a second groove traversing said first groove and said bore;

a cover member forming a cavity adapted to receive said main body, said cover member having at least one cutting element disposed within said cavity aligned to fit into said second groove upon insertion of said main body into said cover member; and locking means for locking said main body and said cover member together.

11. A tracer wire connector in accordance with claim 10 further comprising alignment means for aligning said main body with said cover member.

12. A tracer wire connector in accordance with claim 10 further comprising an insulating material disposed within said cavity.

13. A tracer wire connector in accordance with claim 12, wherein said insulating material is displaceable.

14. A tracer wire connector in accordance with claim 13, wherein said insulating material is a silicone grease.

15. A tracer wire connector in accordance with claim 13, wherein said main body comprises displacement means for displacing said insulating material.

16. A tracer wire connector in accordance with claim 10, wherein said locking means comprises two opposed main body walls disposed along a periphery of said main body, parallel to said first groove, each said wall having an inwardly facing profile extending along a top of each said wall, and said cover member comprises two opposed cover walls corresponding to said two opposed main body walls, said cover walls having an outward facing ledge adapted to engage said inwardly facing profile upon assembly of said main body and said cover member.

17. A tracer wire connector comprising:

a main body having a base and a raised portion connected with said base, said raised portion forming a first groove extending from one side of said base to an opposite side of said base, said raised portion forming an at least partially closed bore extending parallel to said first groove, and said raised portion forming a second groove traversing said first groove and said bore;

a cover member forming a cavity adapted to receive said main body, said cover member having at least one cutting element disposed within said cavity aligned to fit into said second groove upon insertion of said main body into said cover member; and locking means for locking said main body and said cover member together.

18. A tracer wire connector in accordance with claim 17, wherein said at least partially closed bore has a closed off end.

19. A tracer wire connector in accordance with claim 18, wherein said at least partially closed bore is tapered in a direction of said closed off end.

20. A tracer wire connector in accordance with claim 17 further comprising alignment means for aligning said main body and said cover member.

21. A tracer wire connector in accordance with claim 17 further comprising an insulating material disposed within said cavity.

22. A tracer wire connector in accordance with claim 21, wherein said insulating material is displaceable.

23. A tracer wire connector in accordance with claim 22, wherein said insulating material is a silicone grease.

24. A tracer wire connector in accordance with claim 20, wherein said alignment means comprises a plurality of posts extending upward from said base and connected with said base along a periphery of said base.

25. A tracer wire connector in accordance with claim 24, wherein said cover forms a plurality of cover bores, each of said cover bores arranged to receive one of said plurality of posts.

* * * * *